US011140971B2

(12) United States Patent
Record et al.

(10) Patent No.: US 11,140,971 B2
(45) **Date of Patent: *Oct. 12, 2021**

(54) MULTI-DIRECTIONAL SELF-DIRECTING HOLSTER AND ATTACHMENT DEVICE

(71) Applicant: Jason Record, Cumberland, ME (US)

(72) Inventors: Jason Record, Cumberland, ME (US); Todd Sniper, Portland, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/732,494

(22) Filed: Jan. 2, 2020

(65) Prior Publication Data

US 2020/0128945 A1 Apr. 30, 2020

Related U.S. Application Data

(63) Continuation of application No. 16/067,308, filed as application No. PCT/US2017/012897 on Jan. 11, 2017, now Pat. No. 10,561,227.

(60) Provisional application No. 62/277,705, filed on Jan. 12, 2016.

(51) Int. Cl.
*A45F 5/02* (2006.01)

(52) U.S. Cl.
CPC ..... *A45F 5/021* (2013.01); *A45F 5/02* (2013.01); *A45F 5/022* (2013.01); *A45F 2005/025* (2013.01); *A45F 2005/026* (2013.01); *A45F 2200/0583* (2013.01)

(58) Field of Classification Search
CPC .. A45F 5/021; A45F 5/02; A45F 5/022; A45F 2005/025; A45F 2005/026; A45F 2200/0583
USPC ..... 224/200, 414, 251, 667, 197
See application file for complete search history.

(56) References Cited

U.S. PATENT DOCUMENTS

| | | | | |
|---|---|---|---|---|
| 449,460 | A * | 3/1891 | Bannister | B62J 11/00 224/414 |
| 478,092 | A * | 7/1892 | Cushman | B62J 11/00 224/414 |
| 5,730,342 | A * | 3/1998 | Tien | A45F 5/02 224/197 |
| 5,992,717 | A * | 11/1999 | Clewes | A01K 97/10 224/200 |
| 8,141,210 | B2 * | 3/2012 | Colorado | A45F 5/021 24/3.12 |
| D684,104 | S * | 6/2013 | Goldman | D12/411 |
| 2003/0000976 | A1 * | 1/2003 | Malhotra | A45F 5/00 224/197 |
| 2003/0098323 | A1 * | 5/2003 | Taylor | A45F 5/02 224/197 |
| 2003/0141329 | A1 * | 7/2003 | Huang | A45F 5/02 224/197 |
| 2011/0042435 | A1 * | 2/2011 | Weng | B62J 11/00 224/414 |
| 2012/0037677 | A1 * | 2/2012 | Valiquette | B62J 11/00 224/414 |
| 2013/0270315 | A1 * | 10/2013 | Tsai | B62J 11/00 224/414 |

* cited by examiner

*Primary Examiner* — Corey N Skurdal
(74) *Attorney, Agent, or Firm* — Jeffrey Joyce, Esq.

(57) ABSTRACT

A holster and an attachment device for holding an object, the holster having wave-shaped securing arms with that guide the device into a secured position, and the attachment device supporting the holster in a number of positions that may be fixed or rotatable.

15 Claims, 14 Drawing Sheets

MULTI-DIRECTIONAL SELF-DIRECTING HOLSTER AND ATTACHMENT DEVICE

BACKGROUND INFORMATION

Field of the Invention

The invention relates to holsters and attachment devices that are used to attach items such as bottles, phones, canisters and other objects to surfaces or a user's attire.

Background of the Invention

Holsters and attachment devices are well known and are used with a wide variety of devices such as water bottles, mace sprayers, phones, and tools. For example, soccer/football referees frequently use an attachment device such as a clip and holster device to hold canisters containing a vanishing spray that are used in the course of soccer games. The conventional holsters and clips typically secure the item, such as a canister of vanishing spray, in a fixed upright position and use such things as straps, snaps and/or hook-and-loop fasteners to ensure the canister stays in position.

However, in practice the referee is often focused on other events when removing and then replacing such a canister. For example, a runner must be focused on his/her surroundings to avoid injury, and a referee must be focused on the game. In such situations, it is often not practical to use the conventional securing mechanisms that accompany conventional clip and holster devices.

What is needed, therefore, is a clip and holster device that may be affixed in a number of different positions and that directs the canister into the properly secured position regardless of the manner in which user attempts to secure the item.

BRIEF SUMMARY OF INVENTION

The invention is a multi-directional self-directing holster for holding an item, such as a canister, a bottle, or phone, or other object wherein the holster uses securing arms to direct the canister into the proper and secured position, and an attachment device. For example, the attachment device may be a clip that works in conjunction with a number of knobs on the holster to allow a user to secure the holster in a desired position or, alternatively, allow the user to freely rotate the holster.

The design of the holster and attachment device allows a user to position the holster in the direction, i.e., vertical, horizontal with the opening to the left, horizontal with the opening to the right, etc., that is most advantageous for the user's individual preference and method of use. The holster's securing arms guide the canister into the secured position from a wide range of insertion angles and positions. For example, if the user is using the device on a football/soccer field, after using the canister the user must run down the field as play resumes and he needs only apply pressure to the canister against the holster, either from a top-down direction that pushes the bottom of the canister into the top of the holster, or from the side of the can directly against the opening between the sets of securing arms parallel to the secured position, or from a mid-entry tilt-in insertion direction, and the securing arms guide the canister into the secured position.

Together the holster and clip provide a device that allows a user to secure an item with minimal effort or attention, so that the user may focus on any number of other activities.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
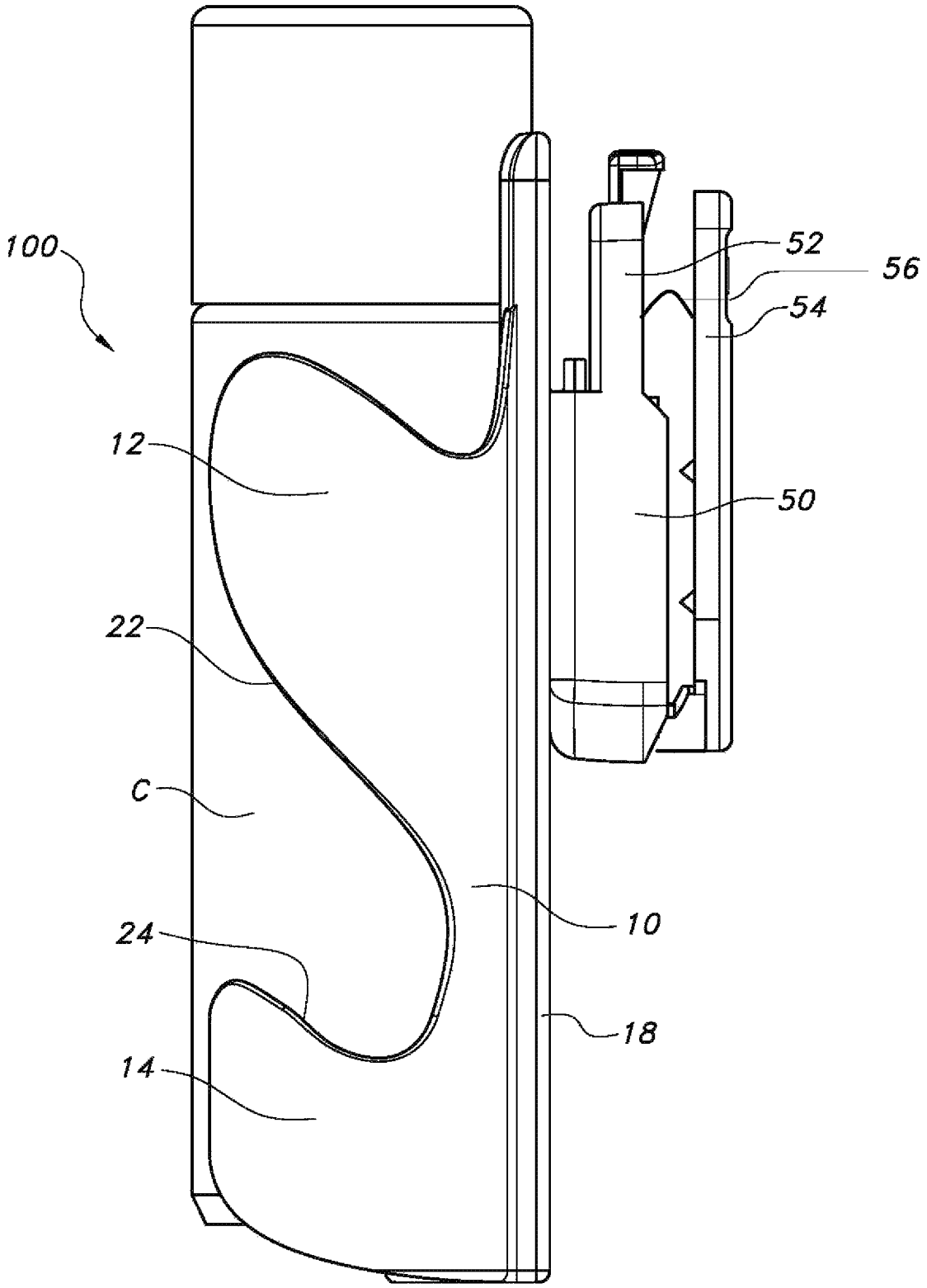
FIG. 1 is a side view of the device according to the invention holding a canister.

FIG. 1 illustrates the device 100 according to the invention including a holster 10 for holding a device such as a bottle, canister, cellular phone, or other object C and an attachment device 50 for securing the holster to a user's clothing. The disclosure will discuss the invention in terms of its use with a canister, however, it is understood that the device may be used with any number of items and is not limited to use with canisters.

FIGS. 2-7 illustrate the holster 10, including upper securing arms 12, lower securing arms 14, a base 16 and a spine 18. The spine 18 has a curved front surface 28 that is shaped to fit the curve of the canister C. The securing arms 12, 14, protrude outward from the spine 18 in a curved manner that guides and secures the canister C. The outer edges 22, 24 of the securing arms are filleted, or rounded, to further guide the canister C into position so as to facilitate easy insertion of the canister C from a number of directions.

Figure 3:
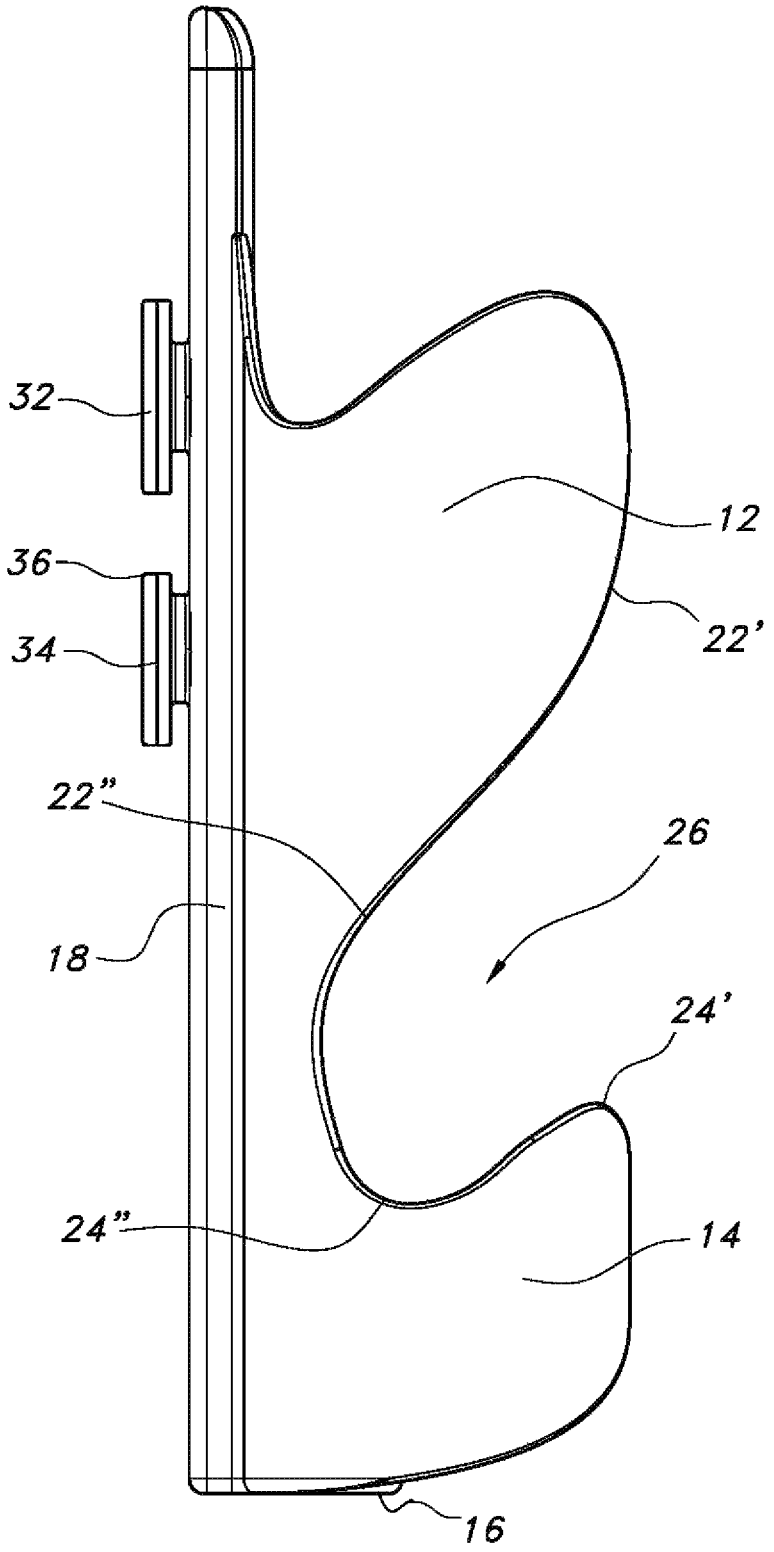
FIG. 3 is a side view of the holster.
Figure 4:
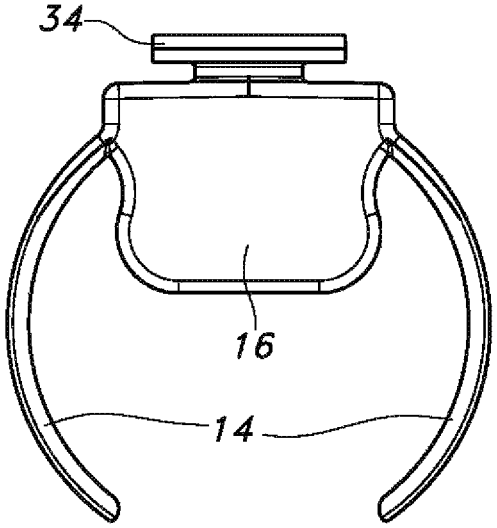
FIG. 4 is a bottom view of the holster.
Figure 5:
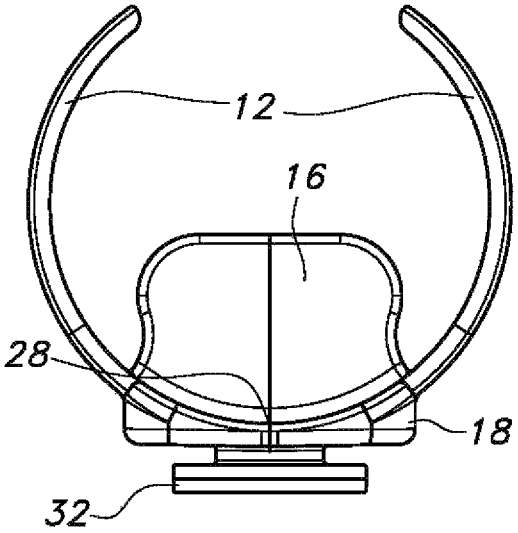
FIG. 5 is a top view of the holster.
Figure 7:
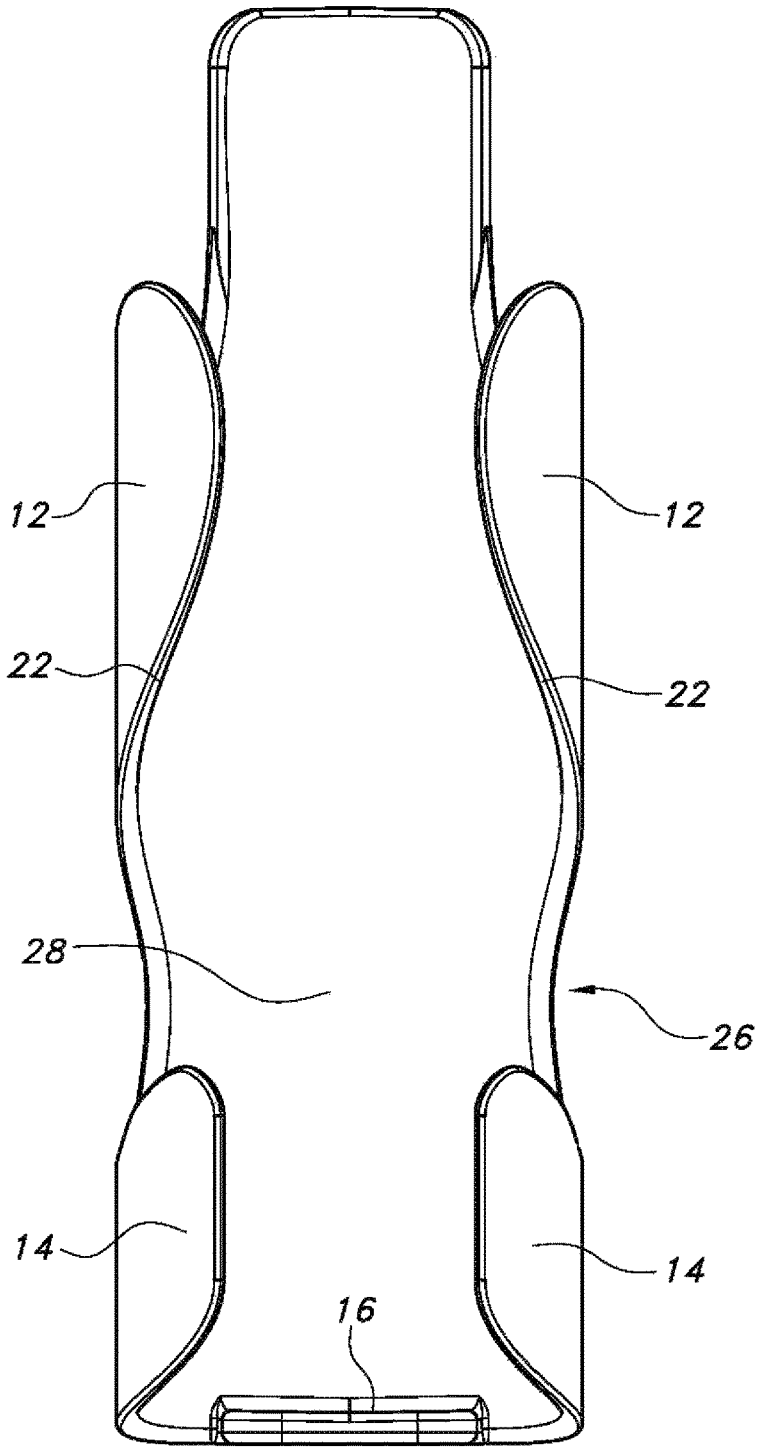
FIG. 7 is a front view of the holster.
Figure 9:
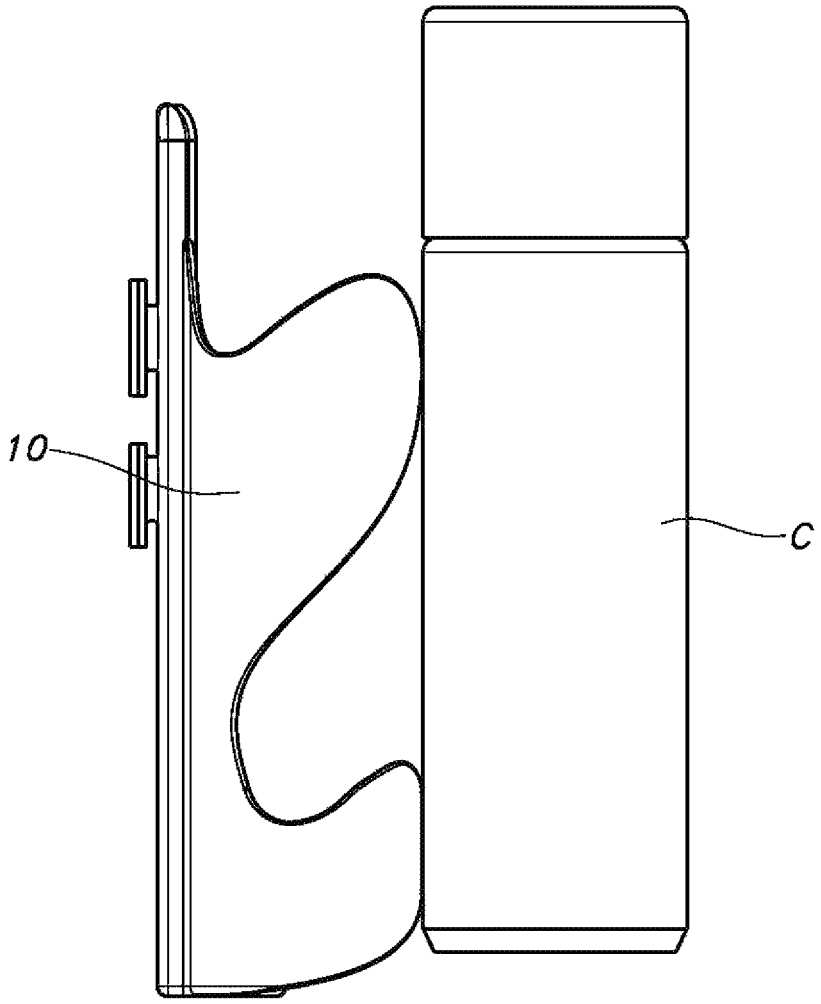
FIG. 9 is a side view of the holster showing the canister being inserted from the side.
Figure 10:
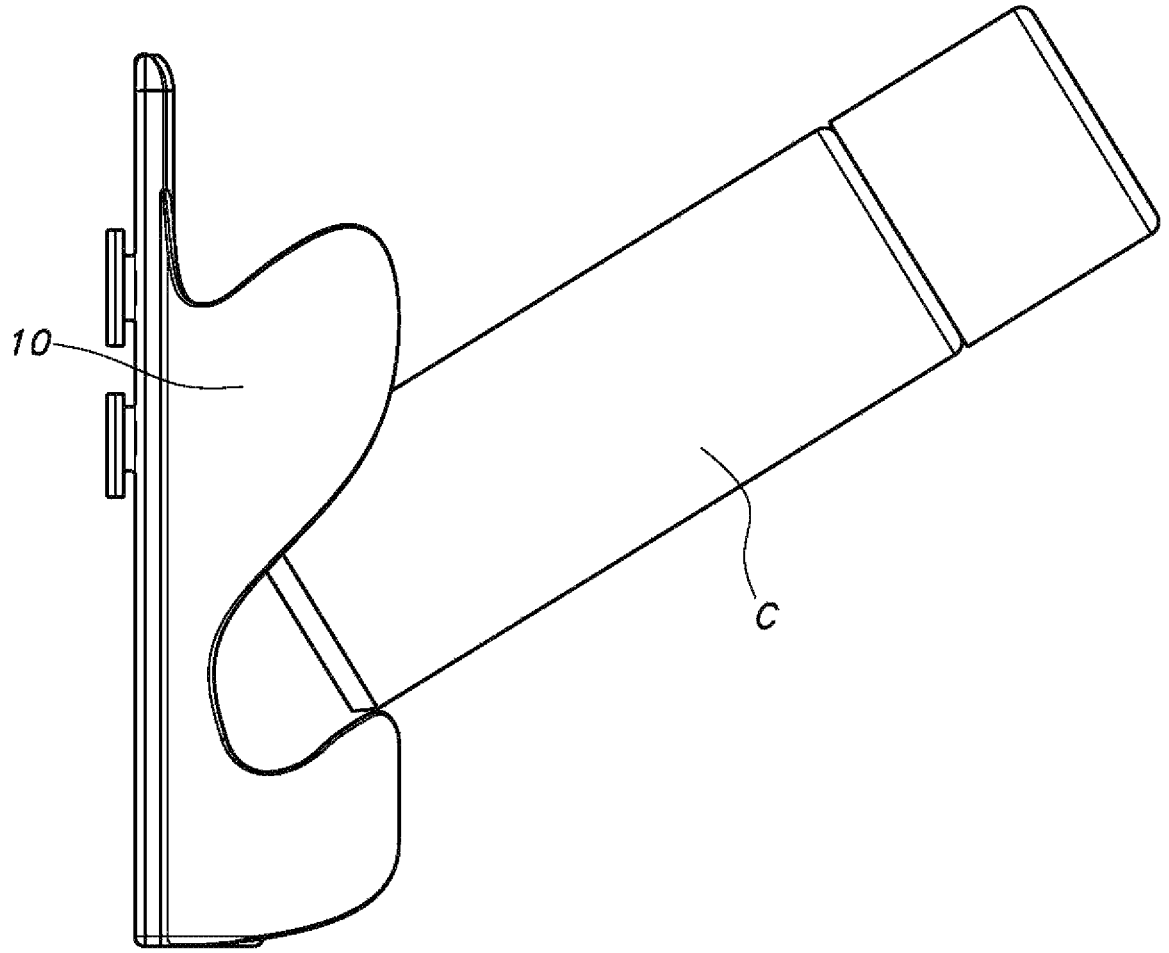
FIG. 10 is a side view of the holster showing the canister being inserted base-first from an inclined angle.
Figure 11:
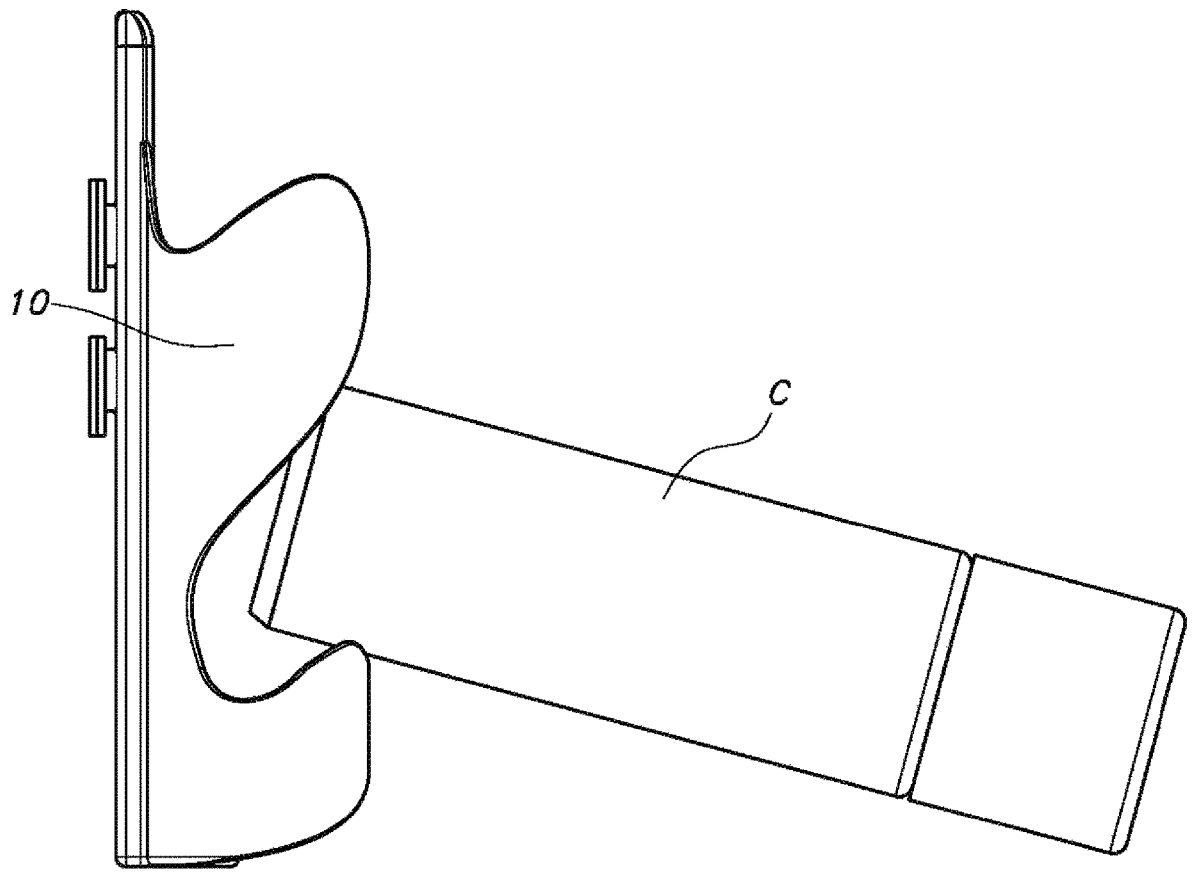
FIG. 11 is a side view of the holster showing the canister being inserted base-first from a declined angle.
Figure 12:
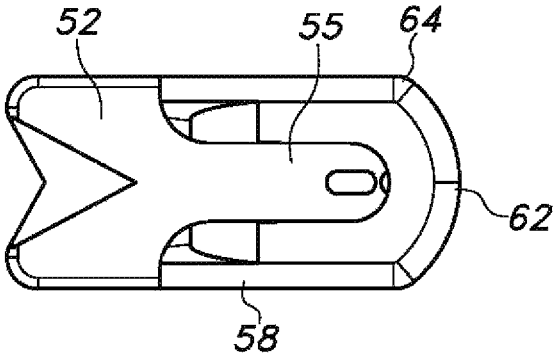
FIG. 12 is a front view of a portion of the clip.
Figure 13:
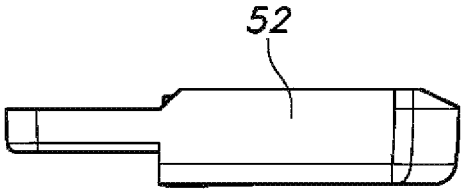
FIG. 13 is a side view of a portion of the clip.
Figure 14:
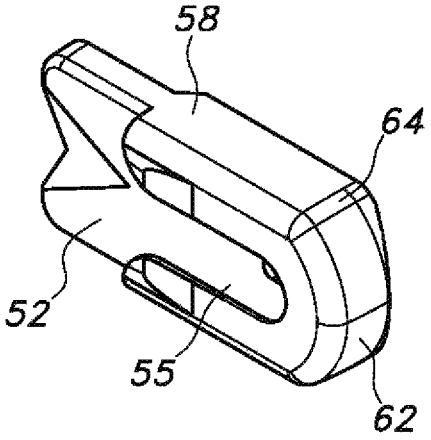
FIG. 14 is a perspective view of a portion of the clip.
Figure 15:
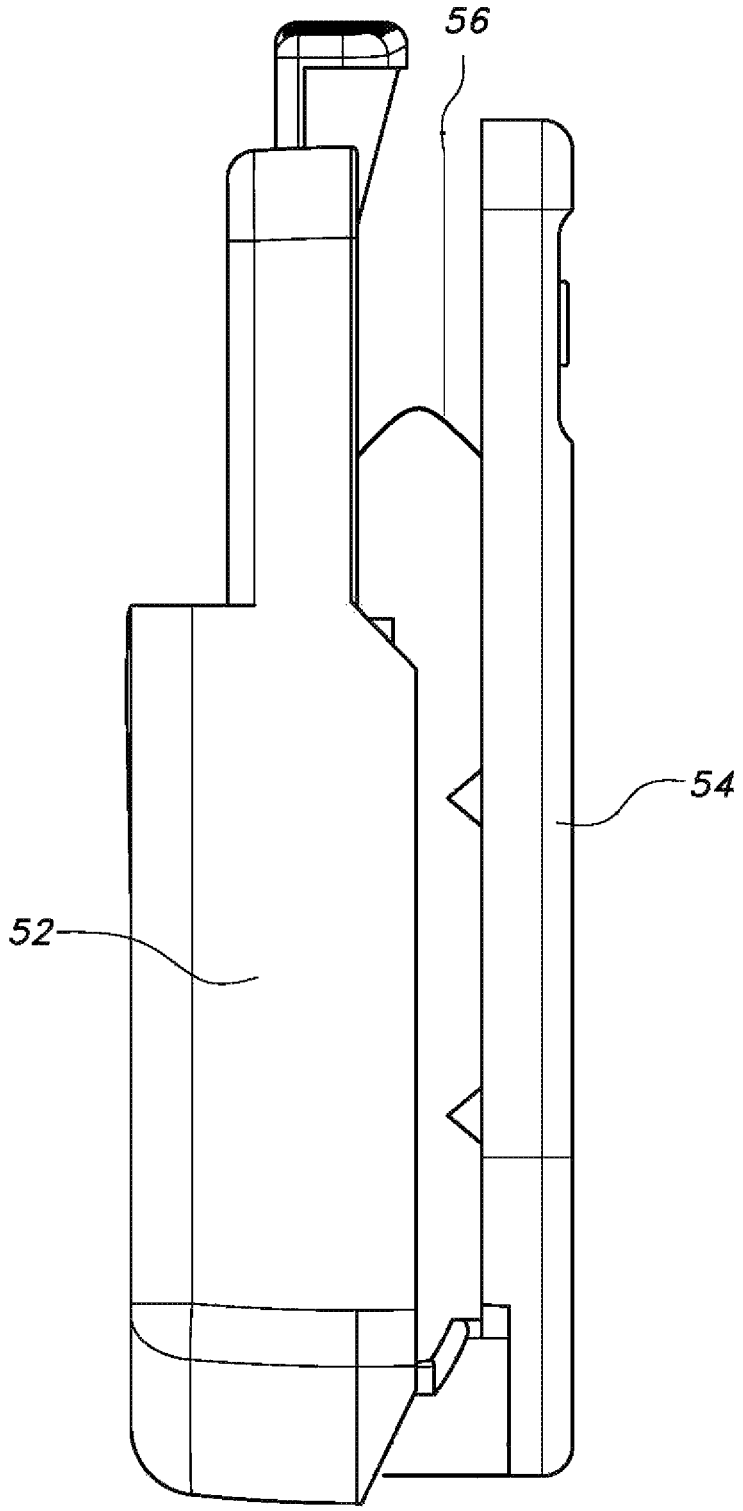
FIG. 15 is a side view of the clip.

More specifically, the securing arms 12, 14, are curved in two ways. First, as best shown in FIG. 3, the securing arms 12, 14, are curved upward in a wave-like manner. These curves help to guide the canister C towards the base 16, particularly when the canister C is inserted into the holster base-first, examples of which are shown in FIGS. 10 and 11. Second, as best shown in FIGS. 5 and 7, the securing arms initially curve outward away from the spine 18 before curving inward, leaving an opening to allow for side insertion, an example of which is shown in FIG. 9, and easy removal of the canister C. In the example shown in FIG. 9, the user must simply apply force to the side of the canister C in the direction of the holster 10.

Figure 2:
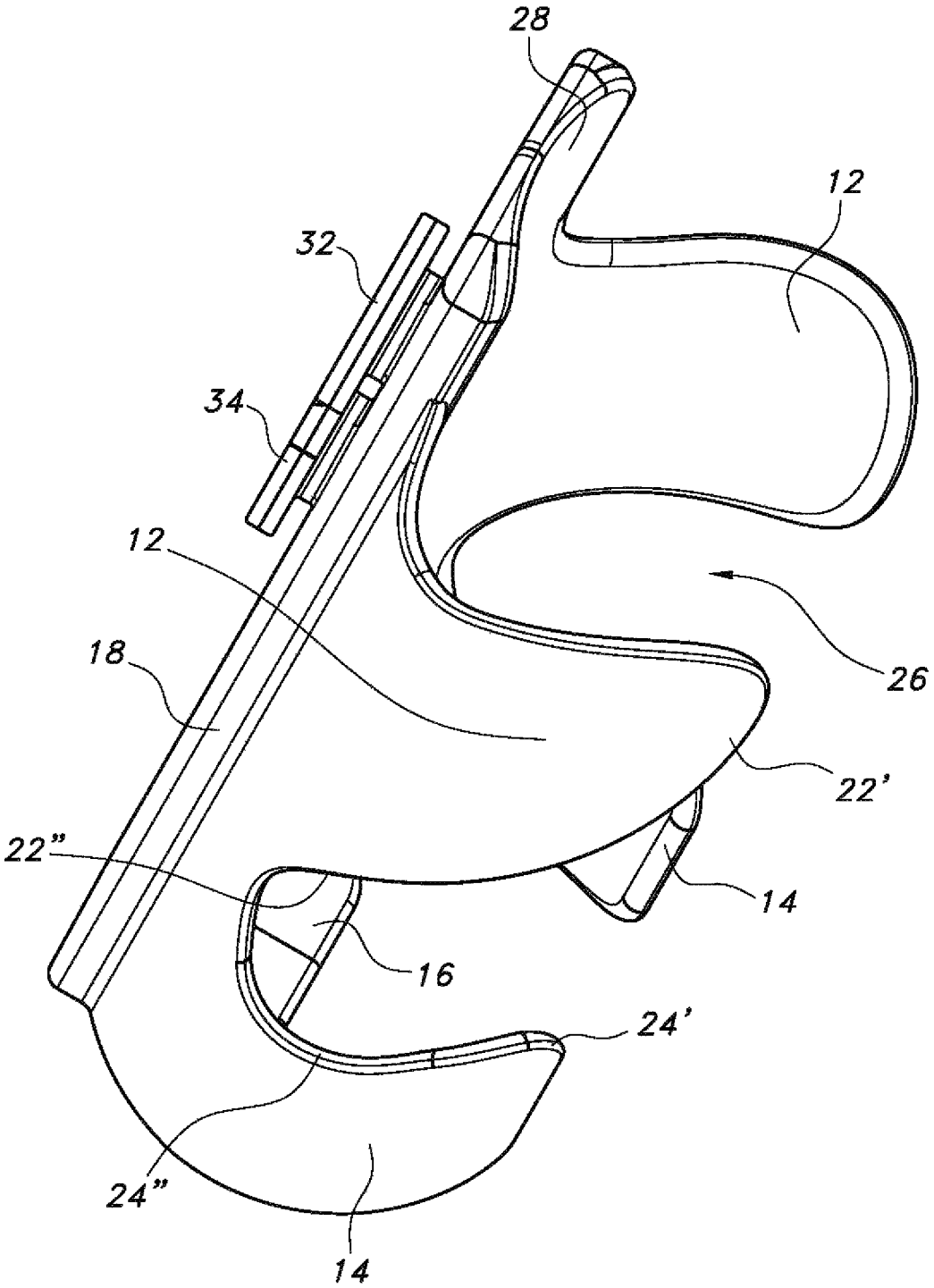
FIG. 2 is a perspective view of the holster.

A space 26, illustrated in FIGS. 2, 3, and 7, is provided between the upper arms 12 and lower arms 14 that is sized to allow the canister C to slide beneath the upper arms 12 but above the lower arms 14, for example during the base-first insertion illustrated in FIGS. 10 and 11, and then snap securely into the secured position above the base 16. For example, if the diameter of the canister C is approximately 1.5 inches, the opening of the space 26 between outer sections 22', 24' of the edges 22, 24, would be approximately 1.75 inches and the space between inner sections 22", 24" of the edges 22, 24 would be approximately 1.0 inch. This allows the canister to be easily inserted between the outer edges 22', 24' and then follow the curve of the arms 22, 24 to the inner edges 22", 24", at which point the base of the canister C contacts the spine 18 and slides into position above the base 16. The curve of the upper arms 12 and filleted edges 22 also allow for angled insertion, similar to that illustrated in FIG. 10, from a position above the upper arms.

Figure 8:
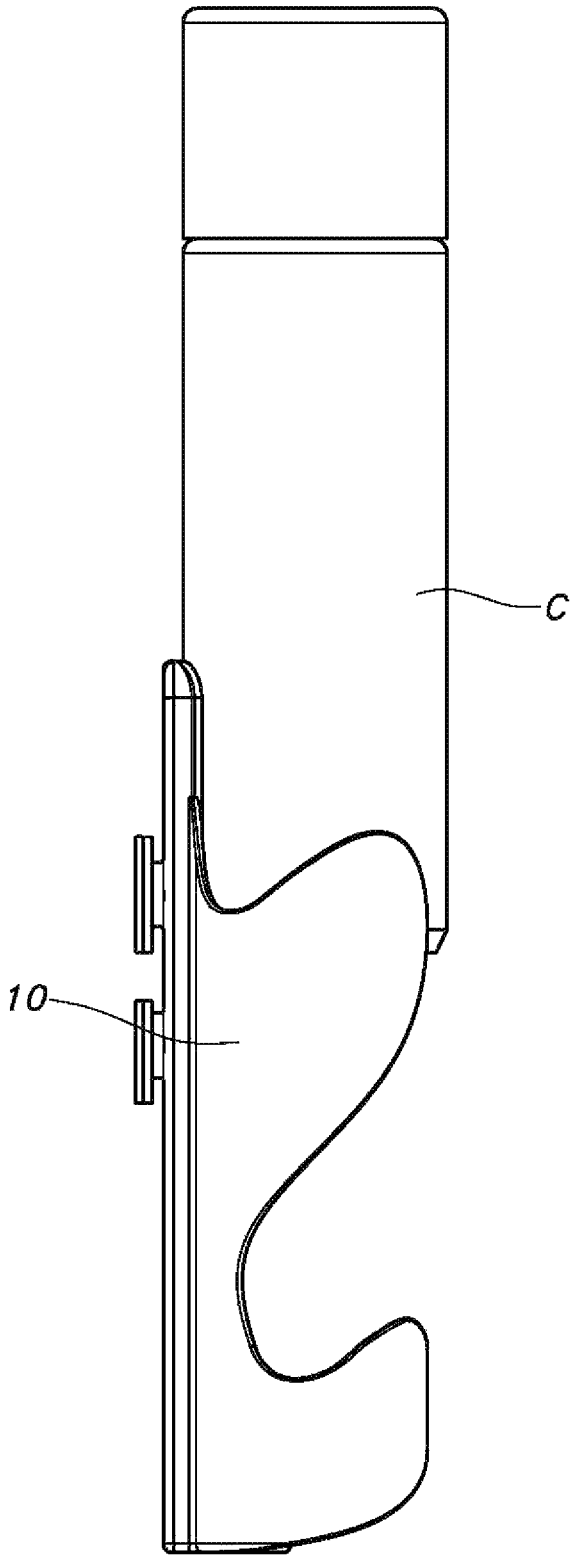
FIG. 8 is a side view of holster showing the canister being inserted from the top.

As mentioned above, the curves of the securing arms 12, 14 and the fillet of the edges 22, 24 allow the canister C to be inserted into the holster 10 from a number of directions and positions. For example, the canister C may be inserted from the top, either straight down as shown in FIG. 8 or from a range of angled directions, similar to the example illustrated in FIG. 10, from the side as shown in FIG. 9, or base-first from a number of angles, examples of which are shown in FIGS. 10 and 11. In each instance, the shape of securing arms 12, 14 direct the canister in to the proper secured position from a wide range of directions and angles of insertion.

In the example shown in FIG. 11, the curves of the upper arms 12 and edges 22, guide the rounded base of the canister C downward, so that even though the base of canister is initially being inserted in the wrong, i.e. upward, direction it is still directed to the secured position. More particularly, the rounded base of the canister C engages the upper arms 12 and, as the user presses the canister C base upward and inward into the narrower opening between the arms, best illustrated in FIG. 7, the edges 22 and curves of the arms 12 guides the canister downward to the space 26, where the canister C slides into the secured position.

Figure 6:
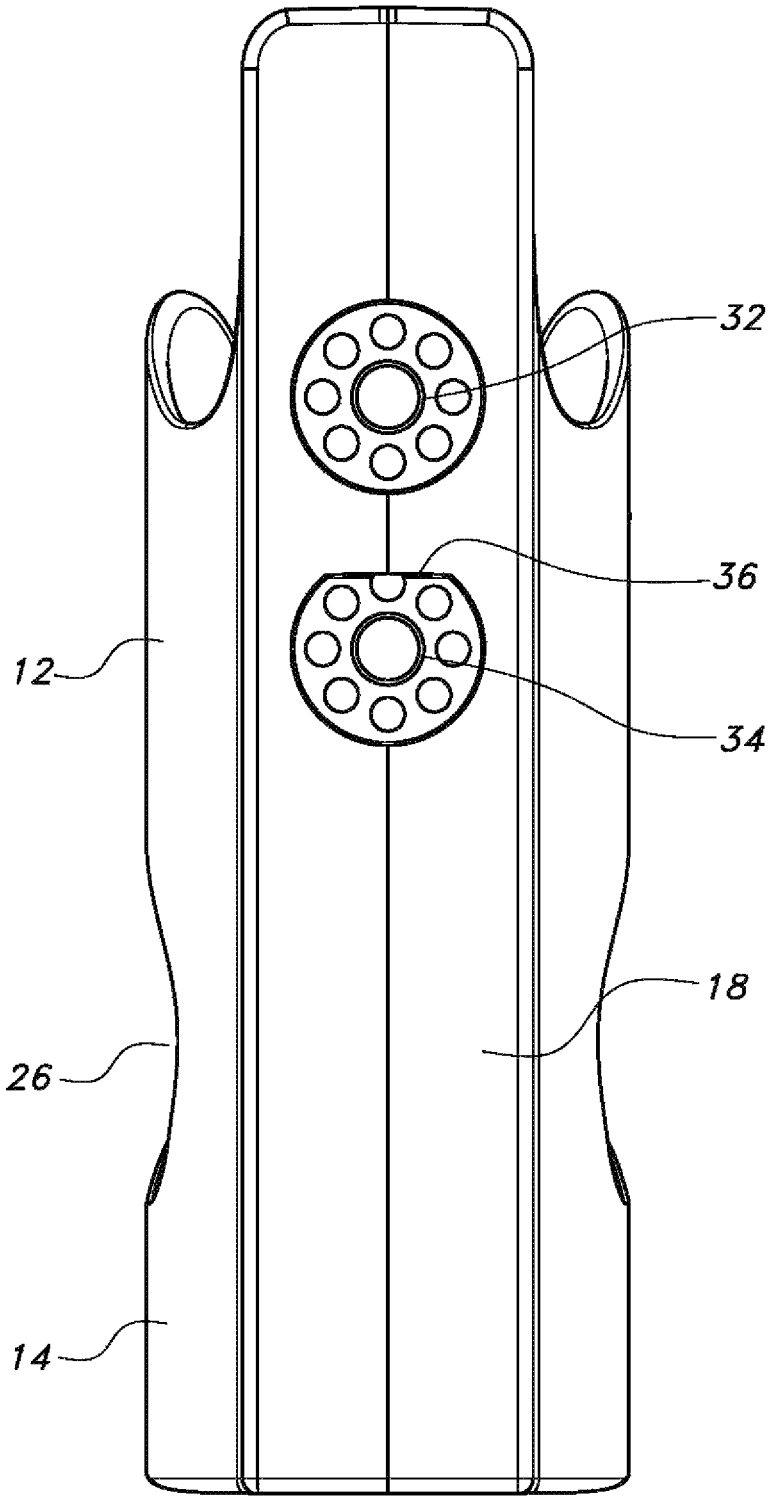
FIG. 6 is a rear view of the holster showing the attachment knobs.

A pair of knobs 32, 34, best illustrated in FIG. 6, are provided on the holster 10 to attach the holster 10 to the clip 50, which is typically secured to a user's clothing, for example, to a user's belt (not shown) or pants pocket (not shown). One knob 32 is rounded while the other knob 34 includes a straight edge 36, which allows the user to choose between securing the holster in a number of locked positions or in a 180-degree rotatable position. In the embodiment shown the knobs 32, 34, are integrated into the holster, however, it is also possible to incorporate the knobs into a separate plate 38, partially shown in FIGS. 17 and 18, or other device (not shown) that is attachable to a holster 10 or other device (not shown), or to another device that is not a holster, through any suitable conventional means, such as, for example, hook and loop fasteners or adhesively.

FIG. 1 and FIGS. 12-18 illustrate the attachment device 50 in the form of a clip that includes a front plate 52, a back plate 54 and a connector 56. As with many conventional clips, it is designed to fit over a belt or into a pocket, with the back plate 54 positioned against the user and the front plate 52 positioned to attach to a device, such as the holster 10. The front plate 52 includes a u-shaped opening 55 that accepts one or both of the knobs 32, 34, and has straight sides 58 and a curved bottom 62. In the embodiment shown, the connector 56 is a metal spring clip.

Figure 17:
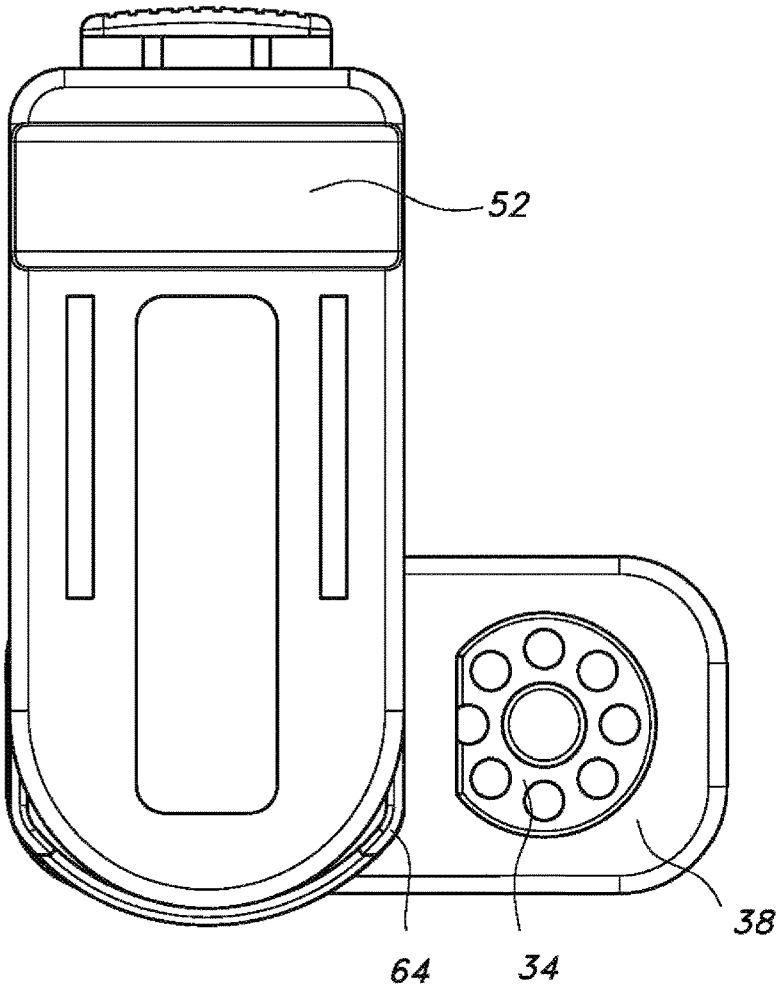
FIG. 17 is a rear view of the clip attached to the rounded knob in a horizontal position.
Figure 18:
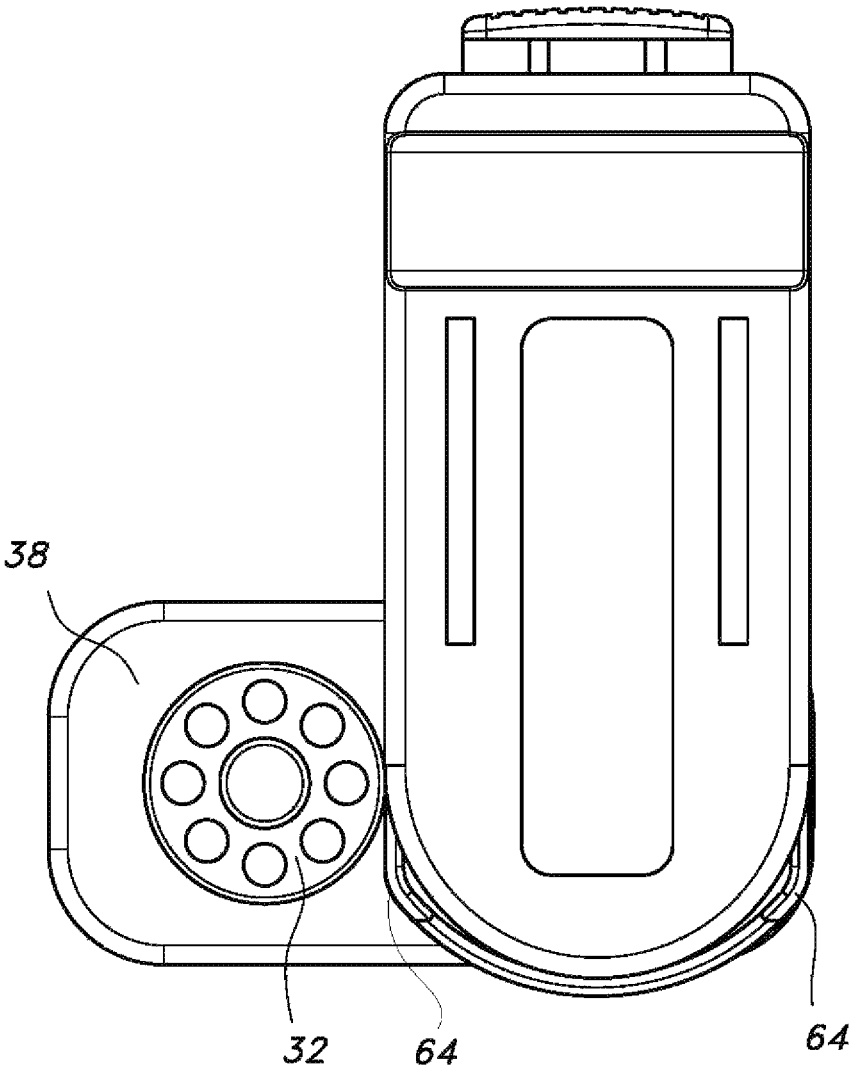
FIG. 18 is a rear view of the clip attached to the rounded knob with a straight edge in a horizontally locked position.

In the embodiment shown, the sides 58 meet the curved bottom 62 at a corner 64. The corner 64 allows the user to lock the holster 10 into a number of fixed positions or, alternatively, to rotate the holster 10 approximately 180 degrees depending upon which knob 32, 34 is/are inserted into the u-shaped opening 55. For example, if the user wishes to lock the holster 10 in a vertical position, he would insert both knobs 32, 34 into the u-shaped opening 55. Alternatively, if the user wishes to lock the holster 10 into a horizontal position, he would insert the knob with the straight edge 34 into the opening 55 as shown in FIG. 18. Using this knob allows the user to lock the holster in a horizontal position facing either left or right. In this configuration the holster 10 cannot rotate because the rounded knob 32 is blocked by the corner 64 and side 58. To attach the holster 10 to the clip 50 in a manner that allows for rotation, the rounded knob 32 is inserted into the opening 55 as shown in FIG. 17. In this configuration, the straight edge 36 of the straight edge knob 34 is positioned towards the corner 64 and is sized to provide enough clearance between the knob 34 and the corner 64 to allow the holster 10 to rotate freely from one side to the other.

Figure 16:
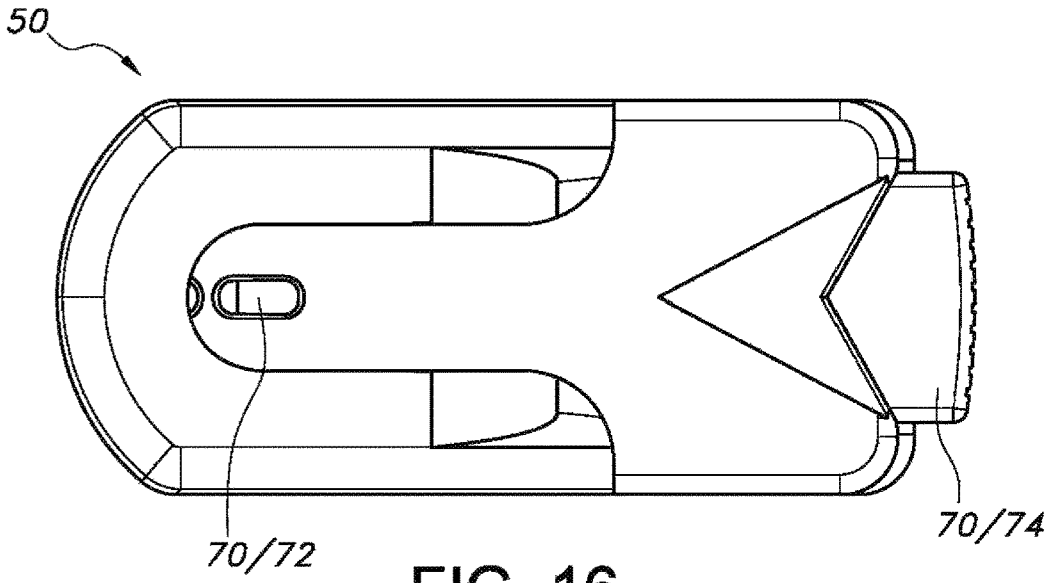
FIG. 16 is a front view of the clip showing the knob receiving mechanism.

FIG. 16 illustrates a conventional locking mechanism 70 that is also provided. The locking mechanism 70 has a latch 72 that snaps into the center of one of the knobs 32, 34. A push button 74 allows the user to depress the latch 72 and remove the holster 10 from the clip 50.

It is understood that the embodiments described herein are merely illustrative of the present invention. Variations in the construction of the holster and clip may be contemplated by one skilled in the art without limiting the intended scope of the invention herein disclosed and as defined by the following claims.

What is claimed is:

1. A holster for holding an object, the holster comprising:

a spine having one or more sets of securing arms, the securing arms having upper edges that curve upward as the securing arms extend away from the spine creating a notch between an outer portion of the securing arms and the spine, the notch having a concave shape, the securing arms upper edges also having an inward orientation so as to wrap at least partially around the object when the object is inserted into the holster.

2. The holster of claim 1, wherein the securing arms first protrude outward and away from the spine and then inward so as to wrap at least partially around the object when the object is inserted into the holster.

3. The holster of claim 1, wherein the one or more sets of securing arms includes at least upper securing arms and lower securing arms.

4. The holster of claim 3, wherein the object is insertable into the holster in a vertical or angled direction from a position above or below the securing upper arms or a position above the lower securing arms or inserted in a parallel horizontal direction towards the upper securing arms and lower securing arms; and wherein the upper securing arms and lower securing arms guide the object into a secured position in the holster above the base and against the spine.

5. The holster of claim 3, further comprising a space between the upper securing arms and lower securing arms, the space sized to allow the object to slide between the upper and lower arms for insertion into the holster.

6. The holster of claim 3, wherein the upper securing arms and lower securing arms have fillet edges that help guide the object into a secured position against the spine and above the base.

7. The holster of claim 3, wherein the upper edges of the upper securing arms create an unencumbered opening such that the object may be inserted from above the upper securing arms.

8. The holster of claim 3, wherein the upper edges of the upper securing arms, after initially curving downward as they extend away from the spine and then curving upward, curve downward to outer edges of the upper securing arms, the outer edges continuing to run towards the lower securing arms; and wherein the shape of the opening between the outer edges of the upper securing arms and the upper edges of the lower securing arms is curved to guide the object into a secured position when inserted between the upper securing arms and lower securing arms.

9. The holster of claim 1, further including a base.

10. The holster of claim 1, wherein the spine has a front surface that is curved to fit the shape of the object.

11. The holster of claim 1, further comprising one or more clip attachment devices on a back side of the spine, the one or more clip attachment devices being securable in a clip.

12. The holster of claim 11, wherein the one or more clip attachment devices comprise two knobs.

13. A clip comprising:

a front plate and a back plate that are connected by a connector, the front plate having approximately straight sides, an approximately rounded bottom having corners, and having a u-shaped opening;

an attachment mechanism comprising at least a first knob and a second knob, the first knob and second knob each sized to fit in the u-shaped opening, the first knob being a rounded knob, the second knob having at least one straight side;

wherein inserting the first knob and the second knob into the u-shaped opening connects the attachment mechanism in a locked vertical orientation; and wherein inserting the first knob but not the second knob into the u-shaped opening secures the front plate to the attachment mechanism in a manner that allows for at least 180 degrees of rotation; and wherein inserting the second knob but not the first knob into the u-shaped opening secures the front plate to the attachment mechanism such that the attachment mechanism is secured in a fixed horizontal position extending in either a right or left direction relative to the front plate.

14. The clip of claim 13, wherein the connector is a spring clip.

15. The clip of claim 13, further comprising a locking mechanism.

* * * * *